US006276857B1

(12) United States Patent
Szekely

(10) Patent No.: US 6,276,857 B1
(45) Date of Patent: Aug. 21, 2001

(54) REFILLABLE ROTARY PRODUCT DISPENSER

(75) Inventor: Alex S. Szekely, Jackson, NJ (US)

(73) Assignee: The Plastek Group, Erie, PA (US)

( * ) Notice: Subject to any disclaimer, the term of this patent is extended or adjusted under 35 U.S.C. 154(b) by 0 days.

(21) Appl. No.: 09/615,210

(22) Filed: Jul. 13, 2000

Related U.S. Application Data

(63) Continuation-in-part of application No. PCT/US99/19786, filed on Aug. 27, 1999, which is a continuation of application No. 09/289,418, filed on Apr. 9, 1999, now Pat. No. 6,039,483, which is a continuation-in-part of application No. 08/744,091, filed on Nov. 5, 1996, now abandoned.

(51) Int. Cl.[7] ..... B43K 5/06
(52) U.S. Cl. ..... 401/175; 401/183
(58) Field of Search ..... 401/68, 172, 174, 401/175, 183, 184, 185, 186, 132, 133, 134, 135; 222/390, 565

(56) References Cited

U.S. PATENT DOCUMENTS

| | | | |
|---|---|---|---|
| 2,159,872 | 5/1939 | Younghusband . | |
| 2,626,847 | 1/1953 | Brown . | |
| 4,232,977 | 11/1980 | Chutter . | |
| 4,298,036 | 11/1981 | Horvath . | |
| 4,363,560 | 12/1982 | Gentile . | |
| 4,521,127 | 6/1985 | Tomburo et al. . | |
| 4,605,330 | 8/1986 | Crowley et al. . | |
| 4,884,912 | 12/1989 | Gueret . | |
| 4,890,944 | 1/1990 | Cousins et al. . | |
| 4,915,528 | 4/1990 | Seager . | |
| 5,275,496 | 1/1994 | Fattori et al. . | |
| 5,401,112 | 3/1995 | Dornbusch et al. . | |
| 5,437,513 | 8/1995 | Favre . | |
| 5,468,084 | 11/1995 | Boninsegni et al. . | |
| 5,496,122 | 3/1996 | Fattori . | |
| 5,529,416 | 6/1996 | Favre . | |
| 5,547,302 | 8/1996 | Dornbusch et al. . | |
| 5,699,936 * | 12/1997 | Sakamoto | 222/107 |
| 6,039,488 * | 3/2000 | Krawczyk et al. | 401/132 |

* cited by examiner

*Primary Examiner*—Gregory L. Huson
*Assistant Examiner*—Peter deVore
(74) *Attorney, Agent, or Firm*—Bachman & LaPointe, P.C.

(57) ABSTRACT

A product dispenser including a product cylinder having a cylinder wall defining a cavity for holding a product, and a housing having a flexible wall defining an inner space for releaseably holding the product cylinder wherein the flexible wall is configurable between a dispensing configuration, wherein the product cylinder is held within the housing, and a refillable configuration, wherein the product cylinder can be removed from the housing.

14 Claims, 1 Drawing Sheet

REFILLABLE ROTARY PRODUCT DISPENSER

CROSS REFERENCE TO RELATED APPLICATION

This application is a Continuation-In-Part of a PCT application Ser. No. PCT/US99/19786, filed Aug. 27, 1999 which is a continuation of patent application Ser. No. 09/289,418, filed Apr. 9, 1999 now U.S. Pat. No. 6,039,483, which is a Continuation-In-Part of patent application Ser. No. 08/744,091 filed Nov. 5, 1996 now abandoned.

BACKGROUND OF THE INVENTION

The present invention is directed to a product dispenser having a flexible housing and a replaceable and/or refillable product cylinder containing a rotary elevator assembly which allows the dispenser to be resupplied with product and the dispenser housing to be reused. This invention is directed to an extrudable product, such as deodorant/antiperspirant.

Many product dispensers do not allow the product to be replaced or refilled once the product dispenser is empty. Subsequently, when the dispenser is empty, the user is required to discard the entire dispenser resulting in a waste of material at a large cost to the consumer and the manufacturer. The need remains for a product dispenser wherein the dispenser housing is reusable and the product is replaceable and/or refillable.

It is therefore the primary objective of the present invention to provide a dispenser wherein the dispenser housing is reusable and the product cylinder is removable allowing the product to be replaced or refilled. This invention allows for a substantial reduction in cost and materials required for consumer use.

Other objects and advantages will appear hereinbelow.

SUMMARY OF THE INVENTION

In accordance with the present invention, the foregoing objects and advantages are readily attained.

According to the invention, a product dispenser is provided which comprises: a product cylinder having a cylinder wall defining a cavity for holding a product; and a housing having a flexible wall defining an inner space for releaseably holding said product cylinder, wherein said flexible wall is configurable between a dispensing configuration, wherein said product cylinder is held within said housing, and a refillable configuration, wherein said product cylinder can be removed from said housing.

BRIEF DESCRIPTION OF THE DRAWINGS

A detailed description of preferred embodiments of the present invention follows, with reference to the attached drawings, wherein.

DETAILED DESCRIPTION

This invention relates to a product dispenser, for dispensing extrudable substances, having a replaceable and/or refillable product container allowing the consumer and manufacturer to reduce the amount of material cost and waste. Some examples of extrudable products would be dentifrice materials (toothpaste, whitening gel) or cosmetic materials (creams, lotions, deodorants).

In accordance with the present invention, a product dispenser is provided which has a flexible wall defining an inner space for releaseably holding a product cylinder via a locking structure and a product cylinder containing a rotatably actuated elevator assembly with a movably disposed plate or elevator for extruding a product from the product cylinder via the dispenser opening located on the top of the housing.

In accordance with the present invention, the flexible wall is positionable between a dispensing configuration, having a dispensing width and a dispensing length, and a refillable configuration, having a refillable width and a refillable length wherein the dispensing width is smaller than the refillable width and the dispensing length is larger than the refillable length. A locking structure is provided, which in one embodiment comprises the engagement between the radially extended portion of the product cylinder and the side openings located on the flexible wall of the housing. When the flexible wall is in its dispensing configuration, the radially extended portion of the product cylinder protrudes from the flexible housing via the side opening. This engages the locking structure preventing the product cylinder from being removed from the flexible housing while allowing rotation of the cylinder relative to the housing. In addition, this engages a keyed structure of the housing with a keyed counterpart of the elevator assembly preventing the threaded rod from rotating relative to the flexible wall. When the radially extended portion of the product dispenser is rotated relative to the threaded rod, the elevator is forced upward toward the top of the dispenser via the threaded rod. This causes the product to be dispensed via dispenser openings located in the top of the dispenser.

When the flexible wall is in its refillable configuration, the radially extended portion of the product cylinder no longer protrudes from the flexible housing and the locking structure is disengaged. This allows the product cylinder to be removed from the flexible housing. At this point the product cylinder may be replaced or refilled and reinserted into the product dispenser.

In accordance with the scope of the present invention, other locking structures may be used to releasably contain the product cylinder within the product dispenser.

Figure 1:
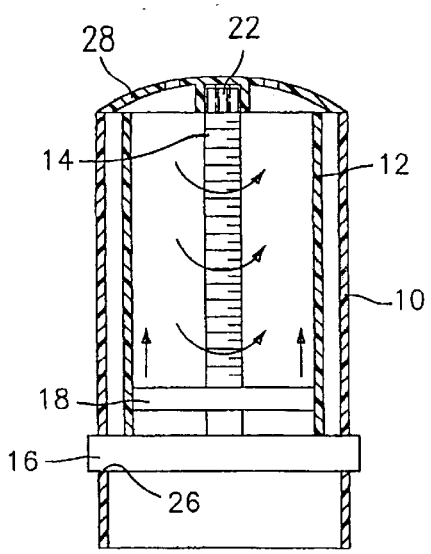
FIG. 1 is a side sectional view of a dispenser in its dispensing configuration in accordance with the present invention showing all major components, including radially extended portion of elevator assembly.
Figure 2:
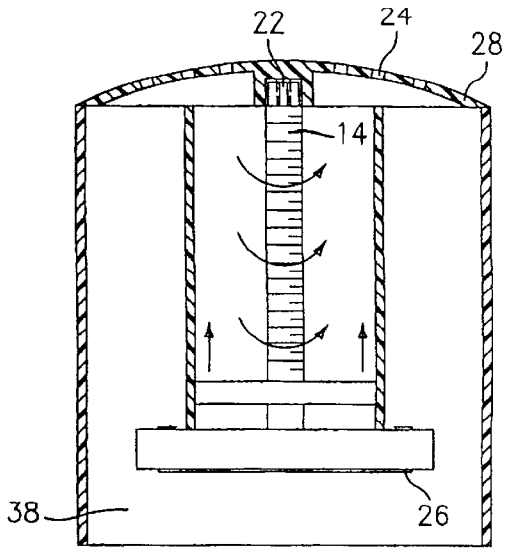
FIG. 2 is a front sectional view of a dispenser in its dispensing configuration in accordance with the present invention showing all major components.

Referring to the drawings, a preferred embodiment of the invention will be discussed. FIG. 1 and FIG. 2 show a dispenser in accordance with the present invention including housing 1 having a flexible wall 10, product cylinder 12, threaded rod 14, radially extended portion 16, elevator 18, keyed structure 22, side opening 26 and an inner space 38.

Referring to FIG. 1 and FIG. 2, housing 1 preferably defines an inner space 38 for containing product cylinder 12 containing product, at least one side opening 26 and a top 28 having dispenser opening 24 and keyed structure 22 to engage a keyed counterpart 20 of product cylinder 12 as will be discussed below. Product cylinder 12 preferable contains a cylinder wall having an internal surface 40 that has a polygonal shape and an elevator 18 positioned in product cylinder 12 and having, for example at least one radially extending member for engaging internal surface 40, so as to prevent elevator 18 from rotating relative to product cylinder 12. In addition, product cylinder 12 preferably contains a radially extended portion 16 and a threaded rod 14, having keyed counterpart 20. Threaded rod 14 is movably connected to product cylinder 12, preferably rotatably connected, so that rotation of cylinder 12 and elevator 18 relative to threaded rod 14 moves elevator 18 within cylinder 12 as desired so as to dispense product.

Figure 3:
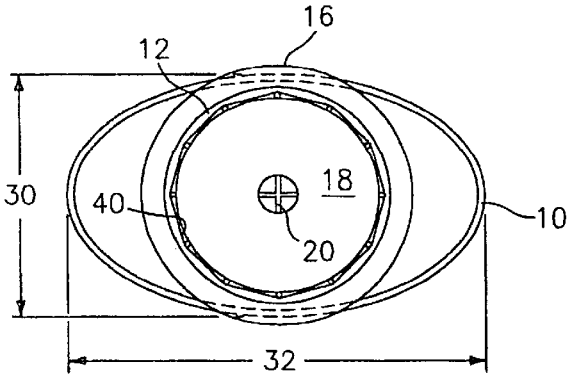
FIG. 3 is a top down view of a dispenser in its dispensing configuration in accordance with the present invention with the top removed.
Figure 4:
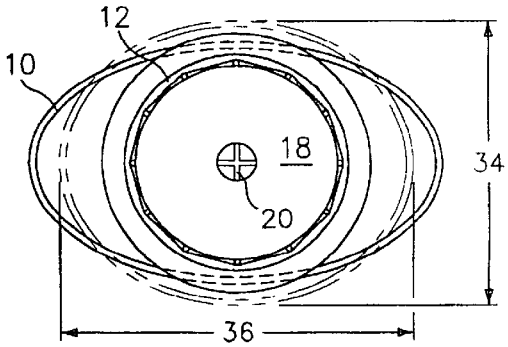
FIG. 4 is a front sectional view of a dispenser in its refillable configuration in accordance with the present invention with the top removed.

FIG. 3 and FIG. 4 show a top down view of a product dispenser in the dispensing configuration and the refillable configuration, respectively.

Referring to FIG. 3, the dispensing configuration of flexible wall 10 preferably has a dispensing width 30 and a dispensing length 32 wherein the dispensing width 30 is smaller than the dispensing length 32. In addition, the dispensing configuration of flexible wall 10 preferably has a dispensing width 30 such that radially extended portion 16 protrudes from side opening 26 thereby rotatably engaging product cylinder 12 within housing 1 for use as desired. In this embodiment, opening 26 of flexible wall 10 and radially extended portion 16 of product cylinder 12 provide a releasable locking structure for holding product cylinder 12 in housing 1.

Referring to FIG. 4, the refillable configuration of flexible wall 10 preferably has a refillable width 34 and refillable length 36 wherein refillable width 34 is larger than dispensing width 30 and refillable length 36 is smaller than dispensing length 32. In addition, the refillable configuration of flexible wall 10 preferably has a refillable width 34 such that radially extended portion 16 of product cylinder 12 does not protrude from side opening 26 thereby disengaging the locking structure and allowing product cylinder 12 to be removed for refilling or replacement.

As is readily appreciated, flexible wall 10 can be configured to the refillable configuration by applying a squeezing force to dispensing length 32 of flexible wall 10. Flexible wall 10 is preferably formed so as to be biased towards the dispensing configuration, whereby releasing the squeezing force allows flexible wall 10 to return to the shape of FIG. 3.

As illustrated in FIG. 3 and FIG. 4, this invention is capable of two configurations: a dispensing configuration (FIG. 3) and a refillable configuration (FIG. 4).

As illustrated in FIG. 3, when the product dispenser is in the dispensing configuration, inner space 38 has a width equal to dispensing width 30 and a length equal to dispensing length 32. This allows radially extended portion 16 to protrude from side opening 26 engaging the locking structure and preventing product cylinder 12 from being removed. In addition, this allows keyed structure 22 to engage keyed counterpart 20, thereby preventing threaded rod 14 from rotating relative to flexible wall 10. When radially extended portion 16 is rotated relative to flexible wall 10, product cylinder 12 is rotated relative to threaded rod 14. This advances elevator 18 and product disposed thereon in an upward direction along threaded rod 14 thereby dispensing the product from dispenser opening 24. This allows the elevator 18 to traverse the entire length of product cylinder 12 extruding the entire product.

As illustrated in FIG. 4, when the product dispenser is in the refillable configuration, inner space 38 has a width equal to refillable width 34 and a length equal to refillable length 36. A key feature of this configuration is that refillable width 34 is larger than dispensing width 30 such that radially extended portion 16 does not protrude from side opening 26, thereby disengaging the locking structure allowing product cylinder 12 to be removed from inner space 38. This allows product cylinder 12 to be refilled or replaced and housing 1 to be reused.

In accordance with the present invention the housing 1, flexible wall 10, product cylinder 12, threaded rod 14, radially extending portion 16, and elevator 18 may be constructed of any material suitable to the desired end product. An example of a suitable material is polypropylene.

In addition, this product dispenser in accordance with the present invention advantageously provides for reduced material cost and reduced material waste while maintaining a normal product dispenser holding capacity.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

I claim:

1. A product dispenser comprising:

a product cylinder having a cylinder wall defining a cavity for holding a product;

a housing having a flexible wall defining an inner space for releaseably holding said product cylinder wherein said flexible wall is configurable between a dispensing configuration wherein said product cylinder is held within said housing, and a refillable configuration wherein said product cylinder can be removed from said housing; and a rotation-actuated elevator non-rotatably disposed in said product cylinder relative to said cylinder wall.

2. A product dispenser according to claim 1, wherein said flexible wall in said dispensing configuration has a dispensing width and a dispensing length which is larger than said dispensing width and in said refillable configuration has a refillable width and a refillable length which is larger than said refillable width, wherein said refillable width is larger than said dispensing width.

3. A product dispenser according to claim 1, wherein said housing further comprises a top portion having a bottom side, a keyed structure disposed on said bottom side and a dispenser opening for dispensing a product, and wherein said product cylinder further comprises a rotatably actuated elevator assembly, wherein said elevator assembly engages said keyed structure in said dispensing configuration.

4. A product dispenser according to claim 3, wherein said elevator assembly comprises an elevator movably disposed in said cavity and having a threaded opening, and a threaded rod having a keyed counterpart, wherein said threaded rod is screwed through said threaded opening and is rotatably disposed in said cavity relative to said product cylinder, and said keyed counterpart engages said keyed structure in said dispensing configuration.

5. A product dispenser according to claim 1, wherein said flexible wall further comprises a locking structure for rotatably holding said product cylinder within said inner space in said dispensing configuration.

6. A product dispenser according to claim 5, wherein said locking structure comprises an opening in said flexible wall for engaging said product cylinder.

7. A product dispenser according to claim 6, wherein said product cylinder further comprises a radially extended portion which engages said opening in said dispensing configuration.

8. A product dispenser according to claim 7, wherein when said dispenser is in said refillable configuration, said radially extended portion does not engage said opening thereby allowing said product cylinder to be removed from said inner space.

9. A product dispenser according to claim 7, wherein when said dispenser is in said dispensing configuration and said radially extended portion is rotated relative to said housing, said elevator assembly is engaged thereby causing said product to be dispensed.

10. A product dispenser according to claim 1, wherein said flexible wall comprises a locking structure for rotatably holding said product cylinder while said flexible wall is in said dispensing configuration and for releasing said product cylinder while said flexible wall is in said refillable configuration.

11. A product dispenser according to claim 1, wherein said cylinder wall has an internal surface, and further comprising a rotation-actuated elevator non-rotatably disposed in said product cylinder relative to said cylinder wall.

12. A product dispenser according to claim 1, wherein said product cylinder comprises a cylinder diameter, having a substantially polygonal internal surface, a radially extended portion extending from said cylinder diameter, and wherein said elevator has at least one radially extended member for engaging said substantially polygonal internal surface.

13. A product dispenser comprising:

a product cylinder having a cylinder wall defining a cavity for holding a product; and a housing having a flexible wall defining an inner space for releaseably holding said product cylinder wherein said flexible wall is configurable between a dispensing configuration wherein said product cylinder is held within said housing, and a refillable configuration wherein said product cylinder can be removed from said housing, wherein said housing further comprises a top portion having a bottom side, a keyed structure disposed on said bottom side and a dispenser opening for dispensing a product, and wherein said product cylinder further comprises a rotatably actuated elevator assembly, wherein said elevator assembly engages said keyed structure in said dispensing configuration.

14. A product dispenser comprising:

a product cylinder having a cylinder wall defining a cavity for holding a product; and a housing having a flexible wall defining an inner space for releaseably holding said product cylinder wherein said flexible wall is configurable between a dispensing configuration wherein said product cylinder is held within said housing, and a refillable configuration wherein said product cylinder can be removed from said housing, wherein said flexible wall further comprises a locking structure for rotatably holding said product cylinder within said inner space in said dispensing configuration, wherein said locking structure comprises an opening in said flexible wall for engaging said product cylinder, and wherein said product cylinder further comprises a radially extended portion which engages said opening in said dispensing configuration.

* * * * *